United States Patent [19]

Osterhout

[11] 4,065,692

[45] Dec. 27, 1977

[54] SPARK GAP ASSEMBLY FOR VOLTAGE SURGE ARRESTERS

[75] Inventor: Joseph C. Osterhout, Bloomington, Ind.

[73] Assignee: Westinghouse Electric Corporation, Pittsburgh, Pa.

[21] Appl. No.: 661,593

[22] Filed: Feb. 26, 1976

[51] Int. Cl.[2] ..... H01J 17/00; H01J 21/00

[52] U.S. Cl. ..... 313/325; 313/326; 313/231.1; 315/35; 361/117

[58] Field of Search ..... 313/325, 326, 306, 217, 313/218, 231.1; 315/35, 36; 317/61, 62

[56] References Cited

U.S. PATENT DOCUMENTS

| | | | |
|---|---|---|---|
| 3,354,345 | 11/1967 | Stetson | 313/231.1 |
| 3,496,409 | 2/1970 | Connell | 313/326 X |
| 3,504,221 | 3/1970 | Osterhout | 313/325 |
| 3,663,856 | 3/1972 | Miske, Jr. | 315/36 |
| 3,737,712 | 6/1973 | Hall | 313/325 |

*Primary Examiner*—Saxfield Chatmon, Jr.
*Attorney, Agent, or Firm*—G. H. Telfer

[57] ABSTRACT

A spark gap assembly of a stack of insulating plates which have on one surface thereof a pair of electrodes preassembled and affixed thereto with a defined spark gap therebetween and a piece of ionizing material disposed on and affixed to each of the plates between the pair of electrodes. The plates are stacked with mating surfaces joined together and with a center plate bearing no electrodes that is joined with mating surfaces of each of two symmetrical groups of electrode bearing plates, and an electromagnetic coil is disposed around the periphery of the center plate.

4 Claims, 4 Drawing Figures

SPARK GAP ASSEMBLY FOR VOLTAGE SURGE ARRESTERS

BACKGROUND OF THE INVENTION

This invention relates to spark gap assemblies for voltage surge arresters such as lightning arresters.

In voltage surge suppressors, such as lightning arresters, there is usually a spark gap assembly containing a number of pairs of electrodes for producing a discharge current path upon occurrence of a predetermined overvoltage. One such assembly is that disclosed in U.S. Pat. No. 3,504,221, Mar. 31, 1970, by the present applicant. In the assembly of the prior patent, a stack of insulating plates is used with the opposing surfaces of the plates each bearing a single electrode for defining a spark gap between that electrode and an electrode mounted on the adjacent surface of an adjacent insulating plate. In order to define the spark gap between the two electrodes, which are physically mounted to separate insulating plates, it was necessary to apply a gauge through an external aperture in the adjacent plates extending through the locus between the electrodes and to rotate the plates relative to each other until the prescribed gap spacing was achieved, then after removing the gauge to secure the plates into a structural unit in which the gap was intended to remain the same. This structure and technique have been successfully used and the operability of arresters employing them has been satisfactory.

There is now increasing emphasis on providing spark gap assemblies that can not only be made reliably and with proper operating characteristics but which can be so made with greater economy and ease of fabrication. In the latter respect it has been considered undesirable to employ an adjustable spark gap as provided in the above-mentioned patent.

Another patent mentioned by way of further background for a spark gap assembly is 3,069,589, Dec. 18, 1962. In the latter patent the spark gap electrodes are formed of embossed areas upon a conductive plate disposed between adjacent insulating plates through which there are apertures so as to define a gap between electrodes on different sides of such an insulating plate. Such an arrangement poses problems in properly setting the gap distance and in the expense of providing the apertured insulating plates and the conductive plates of which the electrodes are formed.

SUMMARY OF THE INVENTION

In accordance with the present invention, a spark gap assembly is provided that principally comprises a stack of insulating plates which have on one surface thereof a pair of electrodes preassembled and affixed thereto with a defined spark gap therebetween. A piece of ionizing material is disposed on and affixed to each of the plates between the pair of electrodes. The plates are stacked with mating surfaces joined together and with a center plate bearing no electrodes that is joined with mating surfaces of each of two symmetrical groups of electrode bearing plates, and an electromagnetic coil is disposed around and bonded to the periphery of the center plate.

The present ivention simplifies the construction of spark gap assemblies as compared with that of U.S. Pat. No. 3,504,221 primarily by reason of the fact that the electrodes defining an individual spark gap are firmly affixed to a single insulating plate and can therefore be preassembled with such prescribed distance as is desired between them. Once such plates have been formed they may be stacked and joined in a unit without any special care or skill being required on the part of assembly personnel. Such an assembly can be made while preserving all the desirable qualities intended to be achieved by U.S. Pat. No. 3,504,221. The plates have a geometry for permitting arc expansion by reason of the external electromagnetic coil so as to achieve extinction of the arc within a reasonable prescribed time. Generally, therefore, it is the intent of the present invention to achieve operating characteristics like those of the previous structure of 3,504,221, but to make distinct improvements thereon by reason of improved structural features that simplify and enhance the convenience of fabrication.

DESCRIPTION OF PREFERRED EMBODIMENTS

Figure 1:
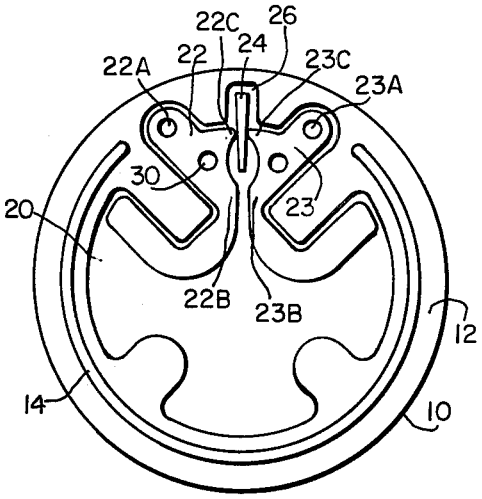
FIG. 1 is a top plan view of one plate of a spark gap assembly in accordance with the present invention.
Figure 2:
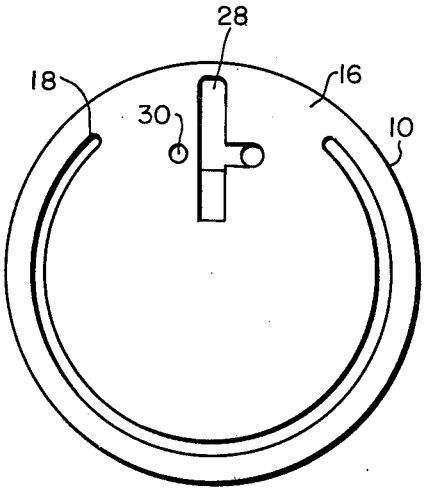
FIG. 2 is a bottom plan view of the plate of FIG. 1.

Referring to FIGS. 1 and 2, an insulating plate 10 is shown having a circular configuration with, in FIG. 1, one surface 12 having a raised arcuate portion or projection 14 and, FIG. 2, the other surface having a recess 18 corresponding in dimension and matable with the configuration of the raised portion 14 of the opposite surface. The first surface 12 has a major recess 20 in part of which are located a pair of electrodes 22 and 23 of a spark gap that are permanently affixed to the surface by a bonding material applied to electrode lobes 22A and 23A that are peripherally disposed and so the bonding material cannot interfere with an arc between the electrodes. A preionizer 24 of a material such as stealite extends between the electrodes 22 and 23. The preionizer 24 is affixed by a bonding material within a recess 26 and extends above the plane of the electrodes. The electrodes 22 and 23 are flat and lay in recess 20.

In assembling the electrodes to the plate 10, the loose electrodes are laid in the approximate location desired. The preionizer 24 may be already bonded in place. A feeler gauge is placed between the electrodes at portions 22B and 23B and the electrodes adjusted in location (a spring fixture may be used). During the adjusting movement the electrodes are in contact with, and pivot on, the preionizer 24 at portions 22C and 23C. When the portions 22B and 23B touch the feeler gauge, cement is deposited at 22A and 22B and heated to set. Then the feeler gauge is removed and the spark gap is set with high precision.

The surface 16 opposing that on which the electrodes are disposed includes not only the recess 18 for accommodating the mating arcuate projection of the opposite surface of a next adjacent plate but also a recess 28 for accommodating a portion of the preionizer 24 that extends above the electrodes 22 and 23. Aperture 30 through the plate permits communication of conductive means from one side of the plate to the other so that upon assembly of a stack of such plates, as shown in FIG. 3, there may be connection made from one of a pair of electrodes on one plate to one electrode of a pair disposed on the surface of the next adjacent plate.

Figure 3:
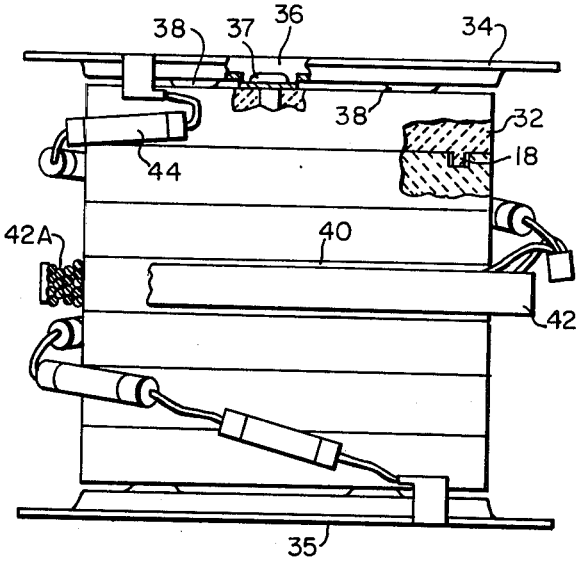
FIG. 3 is an elevation view of a spark gap assembly in accordance with one embodiment of the invention.

Referring now to FIG. 3, an example of a complete spark gap assembly in accordance with this invention is shown. In this example, six preassembled electrode bearing insulating plates 10 of FIGS. 1 and 2 are used although it will be understood more or less such plates may be used in order to get the desired characteristics.

At 32 is shown a broken away portion of two adjacent plates 10 to show how the raised portion 14 of a first surface 12 of one plate mates with the recess 18 of the second surface of the adjoining plate. The several other plates are likewise mutually engaged.

The center one 40 of the plates of the assembly of FIG. 3 is different than the remaining plates 10 of the stack because it is a plate that is configured to have both surfaces that are like surface 16 of FIG. 2. That is, both surfaces of plate 40 have no electrodes and do have recesses 18 for receiving the arcuate projections of the mating surfaces of the adjacent plates 10 that do bear electrodes. This center plate bears no electrodes but it does around its periphery have disposed thereon an electromagnetic coil 42 for arc stretching in accordance with well-known practice. Part of coil 42 is shown in section at 42A. Coil 42 can be wound directly on the periphery of plate 40, preferably on an initial tape layer, and is preferably of an adhesive coated wire that sets rigidly after heating. If desired, a bonding cement may be applied for adhesion of the coil 42 to plate 40 but it is normally not required.

In assembly the various plates are stacked in proper order and may be bonded together for improved handling ability by using an adhesive material that is applied at various local sites between the plates such as on the lobes to which the electrodes are bonded to their supporting plate in the first instance.

The assembly also has at the ends thereof contact plates 34 and 35. The contact plates are each joined by a rivet 37 extending through the aperture 30 of the outside plate as shown at 36 in order to make conductive engagement with one of the pair of electrodes on the first plate. Each contact plate is generally dish-shaped and has a recess that accommodates the rivet 37 and also a plurality of depressions which cause bubbles whose outer configuration is shown at 38 that rest against the surface of the insulating plate. The result is that the contact plate has an inside surface that is generally planar to which may be joined non-linear resistors or other elements (not shown).

The periphery of end plates 34 and 35 may have slots for insertion of resilient sidewall bumpers for locating within a porcelain housing and may also have male tabs for use with female push-on connectors.

A series of voltage grading resistors 44 is connected between each end plate 34 and 35 and one end of coil 42.

It will be apparent that among the variations of the invention from that shown is one in which the surface 12 has a recess and surface 16 has a raised portion instead of the other way around.

The recess 20 in which the electrodes 22 and 23 are disposed can take various configurations including one that is uniformly concentric with the circular edge of plate 10. The "three leaf clover" configuration shown is preferred because it adds to the length of arc sustainable between the electrodes.

Merely by way of more specific example, the insulating plates 10 and 40 may be of a refractory type insulating material such as permeable fused white alumina, the electrodes and conductive interconnections may be of any good conductive material that is readily formable to the desired shape such as copper or phosphor-bronze, and the bonding material for joining the electrodes 22 and 23 and the preionizer 24 to the plate 10 is a cement type material such as an epoxy available commercially called Uniset Epoxy Adhesive. This material has a long shelf life at room temperature but sets quickly at elevated temperatures (about 3 minutes at 320° F). Such a bonding material is convenient to use also for cementing the adjacent plates by application of such material to the electrode lobe portions 22A and 23A before final assembly.

Figure 4:
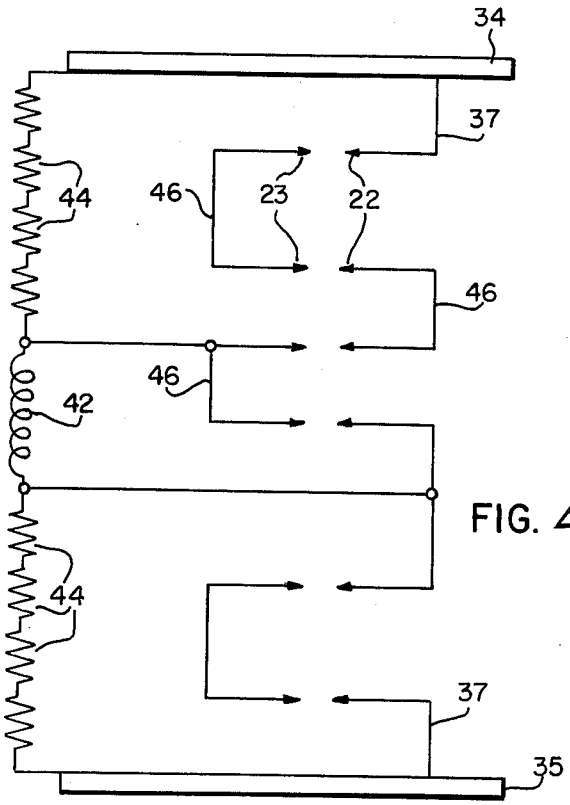
FIG. 4 is a schematic circuit diagram of the assembly of FIG. 3.

The equivalent circuit of the overall stack shown in FIG. 3 by way of specific example of one application of the invention is as shown in FIG. 4. Elements 46 are conductive-interconnections, such as roll or spiral pins, through the apertures 30 of the various plates for interconnecting the electrodes. Coil 42 is connected across one of the spark gaps such as by wire tabs connected to selected ones of the electrodes.

I claim:

1. A spark gap assembly comprising: a stack of insulating plates, first, second and third plates of said stack having opposing first and second surfaces with said first surface having a raised portion and said second surface having a recess, said raised portion of said first surface of said first plate located within said recess of said second surface of said second plate, said raised portion of said first surface of said second plate located within said recess of said second surface of said third plate; a pair of electrodes disposed on and affixed to individual ones of said stack of plates on a single one of said surfaces thereof and defining a spark gap between said pair of electrodes; said pair of electrodes having a piece of ionizing material disposed therebetween, said piece of ionizing material being affixed within a recess of said surface to which said electrodes are affixed, said pair of electrodes having a first pair of opposing points contacting said preionizer and a second pair of opposing portions that face each other at a location removed from said preionizer, said second pair of portions being spaced a predetermined distance defining a spark gap between said electrodes.

2. A spark gap assembly in accordance with claim 1 further comprising:

a fourth one of said stack of plates having opposing surfaces of which both are like said second surfaces of said first, second and third plates with a recess therein, one of which surfaces of said fourth plate has located within its recess said raised portion of said first surface of said third plate;

fifth, sixth and seventh plates of said stack being configured like said first, second and third plates with opposing first and second surfaces having a raised portion and a recess, respectively, said fifth plate having its raised portion located within said recess of said second surface of said fourth plate;

said first, second, third, fifth, sixth and seventh plates each having a pair of said electrodes affixed only on said first surfaces thereof.

3. A spark gap assembly in accordance with claim 2 further comprising: an electromagnetic coil disposed about and bonded to the periphery of said fourth plate;

first and second contact plates of conductive material affixed to said second surfaces of said first and seventh insulating plates, respectively, by respective conductive means extending from said contact plates through said insulating plates and engaging one of said pairs of electrodes on said first surfaces of said insulating plates; and conductive means respectively extending through said second, third, fourth, fifth and sixth plates between individual ones of said pairs of electrodes to connect said spark gaps in series electrically.

4. A spark gap assembly in accordance with claim 3 wherein:

said contact plates have a recess for said conductive means; and a flat contact surface on their outer face.

* * * * *